United States Patent [19]

Spinks

[11] 4,394,887

[45] Jul. 26, 1983

[54] LADDER STANDOFF DEVICE

[76] Inventor: Donald E. Spinks, 2808 Gennessee Ave., West Palm Beach, Fla. 33409

[21] Appl. No.: 308,871

[22] Filed: Oct. 5, 1981

[51] Int. Cl.[3] ..... E06C 7/48

[52] U.S. Cl. ..... 182/214; 182/107

[58] Field of Search ..... 182/214, 107, 108, 206, 182/129, 230; 248/210, 238, 235

[56] References Cited

U.S. PATENT DOCUMENTS

| | | | |
|---|---|---|---|
| 972,001 | 10/1910 | Holdorf | 182/214 |
| 1,004,284 | 9/1911 | Lehmann | 182/214 |
| 2,272,642 | 2/1942 | Owen | 182/214 |
| 2,503,351 | 4/1950 | Otterson | 182/214 |
| 2,597,902 | 5/1952 | Roketa | 182/214 |
| 2,599,169 | 6/1952 | Finney | 182/214 |
| 2,710,129 | 6/1955 | Telech | 182/214 |
| 2,788,930 | 4/1957 | Pals | 182/214 |
| 2,797,037 | 6/1957 | Niedojadlo | 182/214 |
| 2,908,345 | 10/1959 | Lund | 182/214 |
| 2,934,163 | 4/1960 | Ladewski | 182/214 |
| 3,072,218 | 1/1963 | Peters | 182/214 |
| 3,100,026 | 8/1963 | Sunshine | 182/214 |
| 3,459,277 | 8/1969 | Frederick | 182/214 |
| 3,713,510 | 1/1973 | O'Dell | 182/214 |
| 3,773,143 | 11/1973 | DelPrete | 182/214 |
| 4,061,202 | 12/1977 | Campbell | 182/214 |
| 4,184,569 | 1/1980 | Grenier | 182/214 |
| 4,311,207 | 1/1982 | Lurry | 182/214 |

FOREIGN PATENT DOCUMENTS

| | | | |
|---|---|---|---|
| 1434446 | 2/1969 | Fed. Rep. of Germany | 182/214 |

*Primary Examiner*—Reinaldo P. Machado

*Attorney, Agent, or Firm*—Pollock, Vande Sande & Priddy

[57] ABSTRACT

A ladder standoff device adapted to be readily attached to and detached from a ladder comprises an elongated axle member having a pair of wheels rotatably mounted at opposing ends thereof, an elongated standoff bar attached to the axle member and extending transverse thereto, and a handle member pivotally attached to the end of the standoff bar remote from the axle member. The standoff device is attached to a rung of the ladder by a pivot structure that is mounted on the standoff bar and consists of a fixed hook member and a cooperating sleeve that is slideable along the standoff bar; and the standoff device may be locked in position by a further attachment member that is slideable along the handle member and adapted to engage a rung of the ladder different from the rung upon which the device pivots. The axle member and standoff bar may each be of telescopic construction to permit adjustment of the distance between the wheels that engage a wall structure adjacent the ladder, and the distance between the axle member and the rung of the ladder upon which the device is pivotally mounted.

10 Claims, 6 Drawing Figures

FIG. 3A
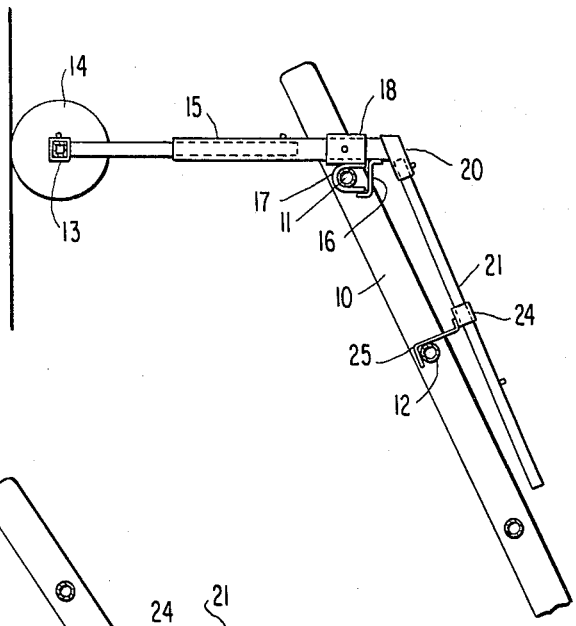
FIG. 3B
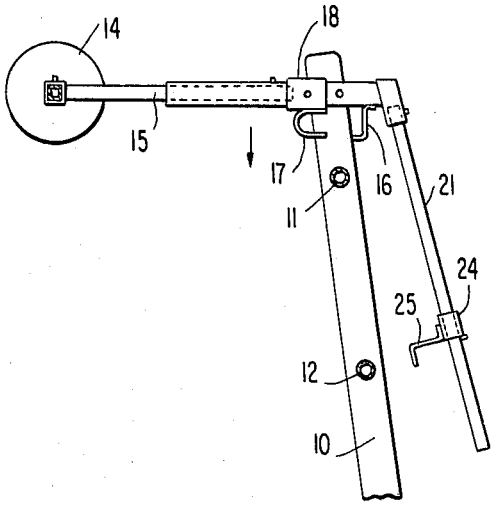
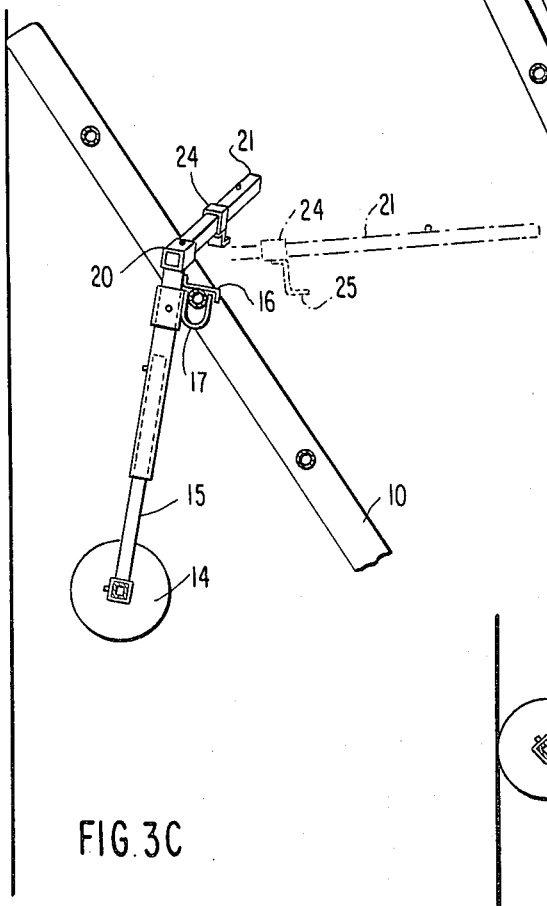
FIG. 3C
FIG. 3D
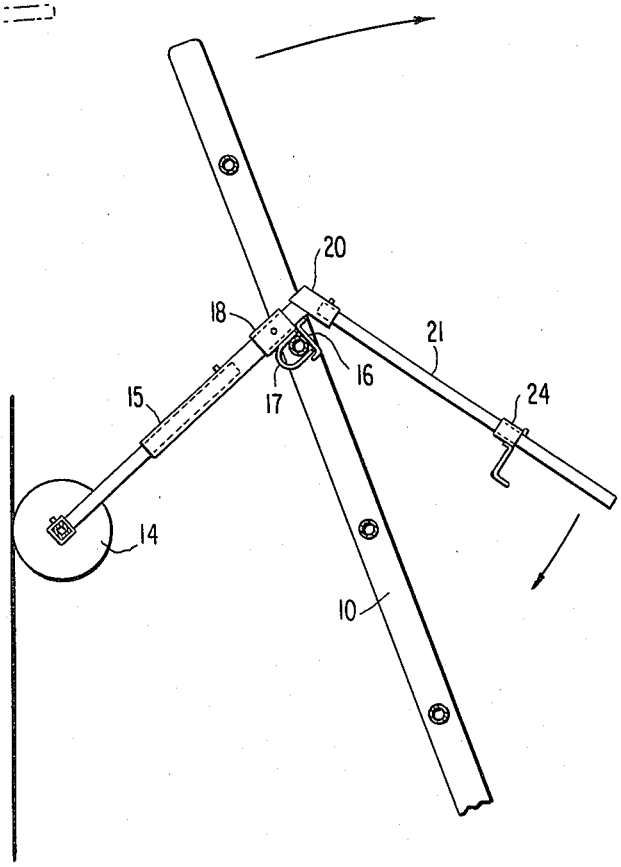

LADDER STANDOFF DEVICE

BACKGROUND OF THE INVENTION

The present invention relates to ladder standoff devices adapted to be attached to a ladder to support the ladder at various spacings from and orientations to an adjacent wall structure and which, more particularly, can be readily attached to and detached from the ladder by a worker standing on the ladder, and readily manipulated between operative and deactivated positions by such a person standing on the ladder.

A variety of ladder standoff devices have been suggested heretofore. Some of these prior devices have taken the form of tubular members which are secured to the rails or rungs of the ladder, e.g., as in Grenier U.S. Pat. No. 4,184,569 and Spencer U.S. Pat. No. 4,061,203, to permit a ladder to be supported adjacent a wall in spaced relation to the wall. Other standoff devices have been suggested wherein the ladder attachment includes one or more wheels along with a mounting and adjusting arrangement for varying the position of the wheels relative to the ladder and an adjacent wall surface; see in this respect Larson U.S. Pat. No. 4,143,743, DelPrete U.S. Pat. No. 3,773,143, O'Dell U.S. Pat. No. 3,713,510, Sunshine U.S. Pat. No. 3,100,026, Niedojadlo U.S. Pat. No. 2,797,037, Pals U.S. Pat. No. 2,788,930, Roketa U.S. Pat. No. 2,597,902, Otterson U.S. Pat. No. 2,503,351, Owen U.S. Pat. No. 2,272,642, Hollister U.S. Pat. No. 1,825,590, Bauer U.S. Pat. No. 1,600,572, and Lehmann U.S. Pat. No. 1,004,284.

The foregoing prior art devices, all of which are structurally different from the standoff device of the present invention, suffer from the common disadvantage that they are fastened to a ladder in a semi-permanent configuration by means of bolts, nuts, clamps or the like. Such arrangements have severe practical limitations inasmuch as it takes a significant time to attach the device to, or detach it from, a ladder whereby, in some circumstances, a worker may forego the use of the device rather than take the time to install it in its intended fashion; and the attachment means themselves tend to be somewhat unsafe since, after period of use, the threads on the bolts, nuts, etc. which are used for attachment purposes may become stripped, or the bolts, etc., may in themselves be lost. Moreover, these prior devices have had limited utility since, as a practical matter, they must customarily be attached to the uppermost part of a ladder to provide any useful clearance between the ladder and a wall and, when so attached, often get in the way of a worker standing on the ladder. Further, the prior art units are ordinarily not adjustable from a wall sufficiently far to permit a worker standing on the ladder to reach wide overhangs and face boards.

A further major disadvantage of the prior art devices is that, typically, they could not be attached to or detached from a ladder while the worker is actually standing on the ladder; and, in addition, the prior devices were so complex and costly that they were considered to have limited, at most, practical use by people working in the trades.

The present invention is intended to obviate all of these disadvantages. The improved ladder standoff unit of the present invention is far simpler in construction than ladder standoff devices suggested heretofore, is arranged so that it can be readily attached to or detached from a ladder while a worker is actually standing on the ladder at an elevated position, and adjusted in a variety of dimensions and orientations while the worker is on the ladder, to permit the worker to reach wide overhangs, faceboards, walls, window openings, etc., without the ladder or the standoff unit getting in the way of the operator of the device. Moreover, the standoff device of the present invention eliminates the need for nuts, bolts, clamps, etc., for attachment of the device to the ladder, and is characterized by attachment arrangements that permanently form a portion of the standoff device itself, and which may be readily manipulated for attachment and detachment purposes, thereby eliminating the possible loss of parts and the resultant difficulties which have characterized prior art units.

SUMMARY OF THE INVENTION

The ladder standoff device of the present invention comprises an elongated axle member having a pair of wheels rotatably mounted at opposing ends thereof for selective rolling engagement with an elongate wall structure adjacent the ladder. An elongated standoff bar is attached at one end to the axle member at a position between the wheels, and extends away from the axle member at substantially right angles thereto. Attachment means are provided on the standoff bar, for attaching the device to any desired rung of the ladder, and said attachment means comprises a fixed abutment, e.g., a hook member, attached to the standoff bar and extending outwardly of the standoff bar, and a cooperating movable abutment member, e.g., taking the form of an elongated U-shaped member that is mounted in opposing relation to the hook member, which is adapted to be slideably positioned along the standoff bar relative to the hook member. These two abutment members, when moved into a position closely adjacent one another along the standoff bar, cooperate to provide a pivotal attachment that is adapted to embrace a selected rung of the ladder, thereby to permit the standoff bar, and the axle and wheels attached thereto, to be pivotally displaced about the said ladder rung. Manipulation of the standoff bar, and the axle and wheels attached thereto, is effected by an elongated handle member that is attached to the end of the standoff bar remote from the axle. The handle is preferably pivotally attached to said end of the standoff bar so that, when the standoff device is not being actively used, the handle can be swiveled to a position wherein it does not interfere with the activities of a worker standing on the ladder. The elongated handle further includes a second attachment member, taking the form for example of a hook member that is slideably displaceable along the handle, adapted to engage another rung of the ladder thereby to lock the standoff device in a fixed operative position.

The axle member and/or standoff bar may be of telescopic construction, and associated with spring-biased locking devices, to permit the effective lengths of the axle member and standoff bar to be varied, and these adjustments can be effected while a worker is standing on the ladder by simply moving the unit to a deactivated position, making the required adjustments, and then repositioning the standoff unit into its operative position.

BRIEF DESCRIPTION OF THE DRAWINGS

The foregoing objects, advantages, construction and operation of the present invention will become more readily apparent from the following description and accompanying drawings wherein:

FIGS. 3A through 3D illustrate how the device may be manipulated in use.

DESCRIPTION OF THE PREFERRED EMBODIMENTS

Figure 1:
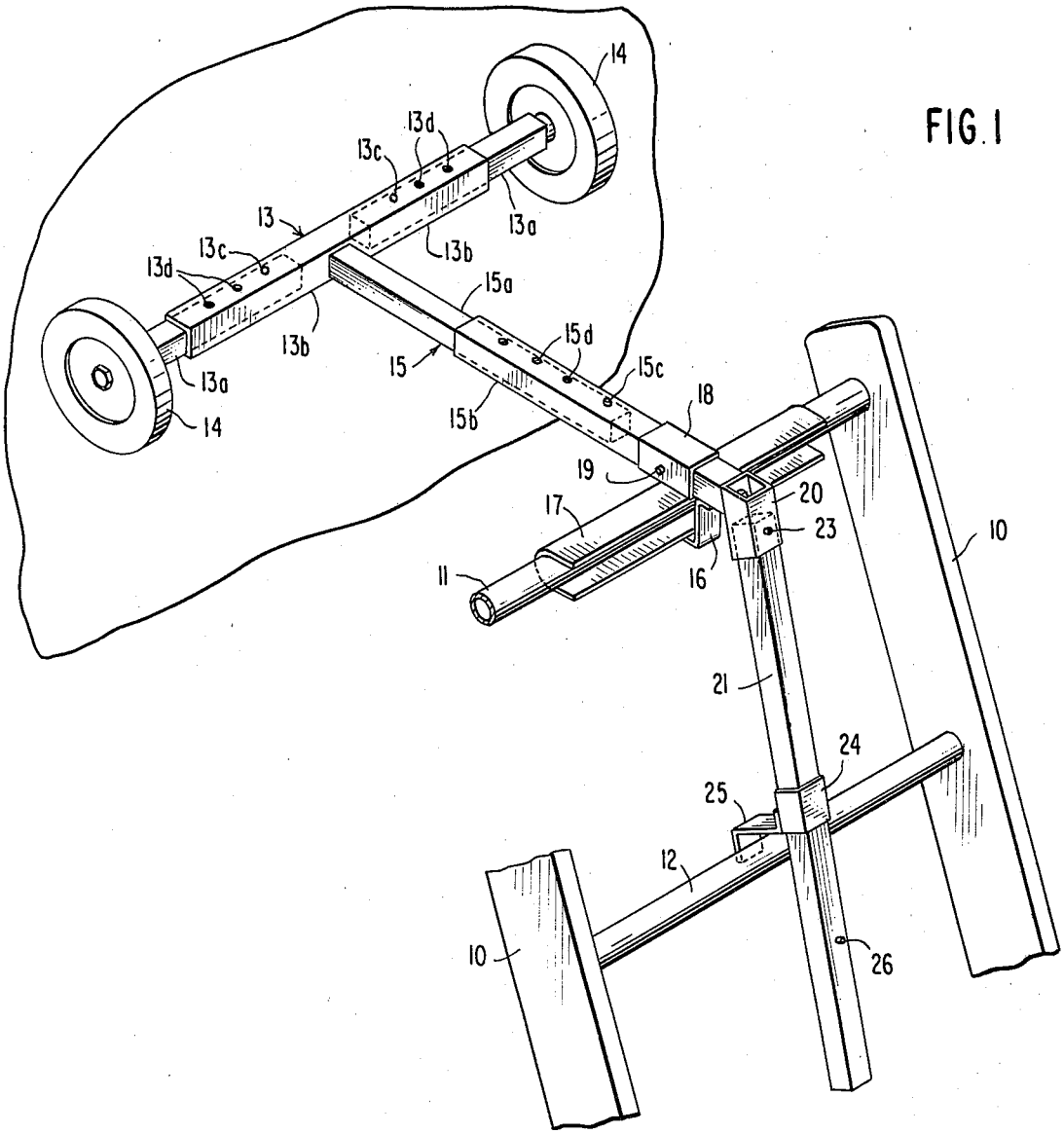
FIG. 1 is a perspective illustration of a standoff device constructed in accordance with the present invention and mounted on a ladder.
Figure 2:
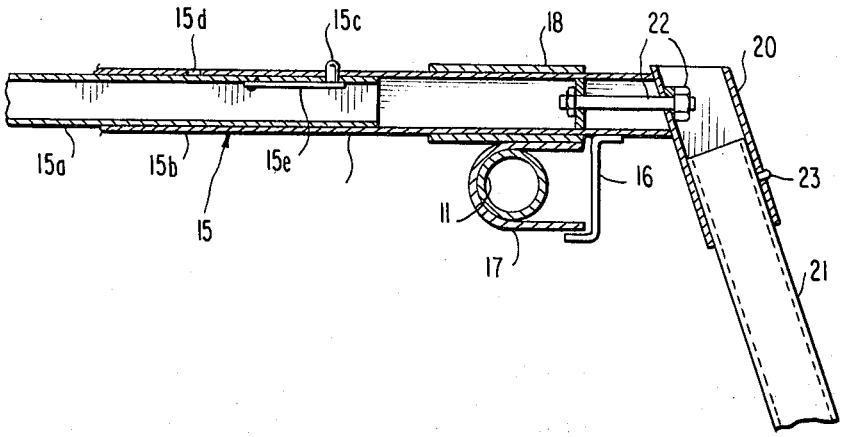
FIG. 2 is a cross sectional view of a portion of the structure shown in FIG. 1.

Referring initially to FIGS. 1 and 2, the ladder standoff device of the present invention is adapted to be attached to a ladder comprising a pair of rails 10 having intervening rungs 11, 12, etc. While the device is illustrated in FIG. 1 as being attached to the uppermost two rungs of the ladder, this is not mandatory and, as will become apparent from the subsequent description, the device can be attached to the ladder at substantially any point along its length in dependence upon the requirements of any particular application.

The standoff device itself comprises an axle member 13 having a pair of wheels 14 rotatably mounted at its opposing ends. The axle member 13 may be of fixed length, but it is preferably constructed in such fashion that its effective length may be varied thereby to vary the effective distance between the two wheels 14. To that effect, for example, the axle member may comprise a pair of stub axles 13*a* which telescope into opposing ends of a hollow support bar 13*b* and are locked in place at a desired position within the support bar by means of spring biased buttons 13*c* that can engage in any one of a plurality of holes 13*d* formed in a wall of support bar 13*b*.

A standoff bar 15 is attached at one end, e.g., by welding, to axle member 3 at a position between the wheels 14, and extends away from axle member 13 at substantially right angles thereto. Standoff bar 15 is also preferably so constructed that its effective length can be varied and, to that effect, may comprise a first member 15*a* which telescopes within a second member 15*b* and which can be locked at a desired adjusted position within member 15*b* by a button 15*c* supported by a leaf spring 15*d* (see FIG. 2) and adapted to engage in any one of a plurality of holes 15*d*. This same kind of leaf spring arrangement can, of course, be employed in conjunction with buttons 13*c* of axle member 13.

Rung attachment means are mounted on standoff bar 15 to permit the standoff bar to be pivotally attached to a rung of the ladder. In the preferred form of the invention this attachment means comprises a downwardly depending hook member 16 which is welded at its upper side to standoff bar member 15*b*, and a cooperating movable member comprising, for example, an elongated ladder rung sleeve 17 having a U-shaped cross section, that is welded to a sleeve 18 which is in turn slideable along standoff bar member 15*b*. When sleeve 18 is slid away from hook member 16 toward axle member 13, the comparatively wide spacing between members 16, 17 permits the device to be readily attached to a ladder rung, e.g., by first placing hook member 16 adjacent one side of the ladder rung and then sliding sleeve 18 and the attached ladder rung sleeve 17 toward hook member 16 until the two members 16, 17 are closely adjacent one another (see FIG. 2). When the parts 16, 17 assume this latter relative position, they cooperate with one another to provide a pivot which completely surrounds the ladder rung so that the standoff bar, axle member, and wheels can be rotated as a unit about said rung. To assure the integrity of the pivot arrangement, a spring biased button 19 is preferably provided on standoff bar 15 for engagement in a cooperating hole that is provided in one wall of the standoff bar sleeve 18.

Hook member 16 is shown in FIGS. 1 and 2 as having a comparatively flat configuration, whereas ladder rung sleeve 17 has a curved or U-shaped configuration. It will be appreciated, however, that the relative positions of these two members can be interchanged and that, in addition, member 16 can be of curved cross section rather than flat, without departing from the principles of the present invention. Moreover, while the dimensioning of the elements 16, 17 shown in FIG. 2 is such that hook member 16 is spaced from the side of rung 11 adjacent thereto, the parts can be repositioned relative to one another so as to closely embrace ladder rung 11 on both sides thereof.

A tubular bracket 20 is mounted at the end of standoff bar 15 remote from axle 13, and is adapted to receive an elongated handle member 21 which is used to manipulate the standoff device between its operative and deactivated positions. The axis of bracket member 20 is transverse to the direction of elongation of standoff bar 15 so that the orientation of handle member 21 is similarly transverse to standoff bar 15. The angle between handle 21 and standoff bar 15 is 112°, which allows the handle to lie approximately parallel to the ladder rings 11, 12 etc., when the device is in its operative position (e.g. see FIGS. 1 and 3A). Moreover, bracket member 20 is preferably attached to the associated end of standoff bar 15 by means of a nut and bolt arrangement 22 that connects the bracket 20 for swiveling motion about an axis that is generally colinear with the direction of extension of standoff bar 15. As will become apparent subsequently (particularly by reference to FIG. 3C) this swiveling arrangement permits the handle 21 to be turned to one side out of the way of a worker standing on the ladder when the standoff device is in its deactivated condition. Handle 21 is preferably releasably locked into bracket 20 by means of a spring biased button 23 that is similar in construction and operation to spring bias buttons 13*c*, 15*c*, and 19 described previously.

A further attachment means is mounted on handle member 21, for use in locking the standoff bar in a desired operative position. The further attachment means comprises a sleeve 24 that is slideable along handle member 21, and which has a hook member 25 attached thereto. Hook member 25 is so shaped that it can overlie and engage another rung of the ladder (e.g. rung 12) that is spaced from the rung (e.g., rung 11) upon which the standoff bar is pivotally mounted. A stop pin 26 is preferably provided on handle 21 to prevent attachment means 24, 25 from sliding off the lower end of said handle member. The elements 24, 25 can be slid onto the other end of the handle member by depression of spring button 23 whereafter the elements 24, 25 are prevented from sliding off the end of said handle by reason of the protruding nature of spring button 23.

Although handle member 21 can be permanently attached to the associated end of standoff bar 15, it is preferred that the handle member be detachable as described. With this configuration, the standoff bar is attached to a desired rung of the ladder, e.g., rung 11, by placing hook member 16 on the upper side of the rung, so that standoff bar 15 hangs downwardly in a generally vertical position due to the weight of the bar, and of axle-wheel arrangement 13, 14. The elements 13–15 are then fixed for pivotal motion about the rung 11 by sliding sleeve 18 upwardly until spring button 19 snaps into place to lock ladder rung sleeve 17 against hook member 16.

When so mounted, wheels 14 hang clear of the adjacent wall surface against which the ladder is leaning (e.g., as shown in FIG. 3C), and the axis of tubular bracket 20 is oriented in a generally horizontal direction. Handle member 21 can then be inserted, generally horizontally, into bracket 20 until spring-bias button 23 snaps into place, whereafter, by pushing downwardly on the handle 21, standoff bar 15 and axle member 13 pivot upwardly about rung 11 to bring wheels 14 into engagement with the wall, and continued movement of the handle 21 downwardly causes the wheels to roll up the wall and to push the ladder away from the wall. When the handle has been moved downwardly to such position that it is closely adjacent to lower rung 12, the overall structure can then be locked in place by sliding sleeve 24 downwardly so that hook member 25 engages the rung 12.

When fully installed, and manipulated into the position described, the device assumes the configuration shown in FIG. 3A. When it is desired to deactivate the standoff device, sleeve 24 is slid upwardly on handle member 21 until hook member 25 is free of rung 12, and sleeve member 18 is slid along standoff bar 15 until the parts 16, 17 are comparatively widely spaced from one another to release the device from rung 11, thereby permitting the device to be completely removed from the ladder as shown in FIG. 3B. It should be noted in this respect that FIG. 3B shows the device being removed from the ladder (or attached thereto) with standoff bar 15 extending generally horizontally, and handle 21 already installed in place; but this has been done simply for ease of illustration. In practice, at the time of removal or installation of the device the parts would take the different configuration previously described, i.e., with standoff bar 15 and wheels 14 hanging downwardly and the ladder resting against the wall surface.

It is not necessary, of course, to completely remove the device from the ladder to deactivate it. Instead, as depicted in FIG. 3C, the attachment means 24, 25 may be moved upwardly on handle member 21 to free the handle member from rung 12 so that the handle member can be pivoted upwardly while the standoff bar 15 and wheels 14 move downwardly away from and free of the wall surface, whereafter the handle member can be swung by means of the swiveling bracket 20 from the position shown in broken line in FIG. 3C to the position of handle member 21 shown in full line therein. In this configuration, the standoff device remains attached to the ladder, but the various parts thereof are in such position that they do not interfere with the activities of a worker on the ladder. Moreover, in this particular position of the parts, a worker standing on the ladder can adjust the effective length of standoff bar 15 and/or axle 13 as may be necessary, whereafter, while still standing on the ladder, the worker can again move handle 21 to its operative position, and then move it downwardly, as shown in FIG. 3D, to push the ladder away from the adjacent wall surface.

It will be appreciated that the present invention allows a worker to paint walls, reach wide overhangs and face boards, do rain gutter work, hang fixtures, etc., on overhangs, and gain access to windows and shutters, all without having the ladder standoff device in the way. It also permits a worker to perform tasks on a building where conventional step ladders would not be practical, e.g., when hedges or shrubbery are located adjacent the building wall on which work is to be done. Further, two standoff devices of the type described can be mounted on two ladders respectively, and when manipulated respectively into the positions shown in FIG. 3A and disposed in facing relation to one another, the resultant structure provides a support for a plank extending between the two axles 13 which can be used as a scaffold. In all of these arrangements, the structure exhibits the major advantages over the prior art which have been earlier described, i.e., the ready attachment, manipulation, adjustment, and/or detachment of the device by a worker who is actually standing on the ladder.

While I have thus described preferred embodiments of the present invention, many variations will be apparent to those skilled in the art. It must therefore be understood that the foregoing description is intended to be illustrative only and not limitative of the present invention, and all such variations and modifications as are in accord with the principles described are meant to fall within the scope of the appended claims.

Having thus described my invention, I claim:

1. A ladder standoff device adapted to be readily attached to and detached from a ladder and adapted, when attached, to be manually varied in position by a person standing on the ladder thereby to vary the orientation of the ladder relative to an adjacent wall structure, said device comprising an elongated axle member having a pair of wheels rotatably mounted at opposing ends thereof for selective rolling engagement with and along a wall structure adjacent the ladder, an elongated standoff bar one end of which is attached to said axle member at a position between said wheels, said standoff bar extending away from said axle member at substantially right angles thereto, first attachment means on said standoff bar, said first attachment means comprising fixed abutment means attached to said standoff bar and extending outwardly of said standoff bar, said fixed abutment means being adapted to be positioned adjacent one side of a rung of the ladder, and movable abutment means adapted to be variably positioned along said standoff bar relative to the opposite side of the ladder rung in opposed relation to said fixed abutment means, said fixed and movable abutment means cooperating with one another to provide a pivotal attachment of said standoff bar on the said ladder rung, handle means attached to the other end of said standoff bar, said handle means being operative upon manual manipulation to pivot said standoff bar about said pivotal attachment thereby to vary the position of said axle member and wheels relative to the adjacent wall structure, and second attachment means mounted on said handle means for selective releasable engagement with a portion of the ladder spaced from the said ladder rung to lock said standoff device against pivotal movement about the said ladder rung.

2. The ladder standoff device of claim 1 wherein said axle member includes portions which are in telescoping relation to one another to permit adjustment of the distance between said pair of wheels.

3. The ladder standoff device of claim 2 including spring-biased locking means for fixing the telescoping portions of said axle member in a desired adjusted position.

4. The ladder standoff device of claim 1 wherein said standoff bar includes portions which are in telescoping relation to one another to permit adjustment of the distance between said axle member and said fixed abutment means.

5. The ladder standoff device of claim 4 including spring-biased locking means for fixing the telescoping portions of said standoff bar in a desired adjusted position.

6. The ladder standoff device of claim 1 wherein said handle means is of elongated configuration and extends away from said standoff bar in a direction transverse to said bar, one end of said handle means being pivotally attached to said other end of said standoff bar for pivotal motion of said handle means relative to said bar about an axis that is substantially colinear with the direction of elongation of said bar.

7. The ladder standoff device of claim 6 wherein said pivotal attachment includes a bracket pivotally attached to said other end of said handle means for pivotal motion about said axis, said handle means being insertable into and removable from said bracket.

8. The ladder standoff device of claim 6 wherein said second attachment means comprises a tubular sleeve slideably mounted on said elongated handle means, and a hook member attached to said tubular sleeve and shaped to overlie and engage a rung of the ladder, other than the rung on which said device is pivotally mounted, when said sleeve is slid along said handle means to a position adjacent the said other rung.

9. The ladder standoff device of claim 1 wherein said fixed abutment means comprises a hook member attached to a fixed position to said standoff bar, said movable abutment member comprising a tubular sleeve slideably mounted on said standoff bar and a curved member attached to said sleeve for movement along said standoff bar toward and away from said hook member.

10. The ladder standoff device of claim 9 wherein said curved member comprises an elongated member of U-shaped cross section extending in a direction substantially parallel to said axle member and transverse to the axis of said tubular sleeve, the open side of said U-shaped member facing said hook member whereby said elongated U-shaped member is adapted to embrace an extended portion of a rung on the ladder when said hook member is disposed adjacent one side of said rung and said sleeve is slid along said standoff bar toward the other side of the said rung.

* * * * *